US005533920A

United States Patent [19]

Arad et al.

[11] Patent Number: 5,533,920

[45] Date of Patent: Jul. 9, 1996

[54] SELF-PROPELLED MUSICAL TOY BALL

[75] Inventors: Abraham A. Arad, Westport, Conn.; Anne Pitrone, New York, N.Y.; Robert W. Jeffway, Jr., Leeds, Mass.

[73] Assignee: Toy Biz, Inc., New York, N.Y.

[21] Appl. No.: 387,128

[22] Filed: Feb. 13, 1995

[51] Int. Cl.[6] ..... A63H 5/00; A63H 29/00

[52] U.S. Cl. ..... 446/409; 446/458

[58] Field of Search ..... 446/409, 462, 446/437, 441, 442, 458, 457, 484; 273/58 E, 58 G

[56] References Cited

U.S. PATENT DOCUMENTS

| | | | |
|---|---|---|---|
| 2,949,697 | 8/1960 | Licitis et al. | 446/458 |
| 3,624,962 | 12/1971 | Sykes | 446/409 |
| 3,798,835 | 3/1974 | McKeehan | 446/442 |
| 5,260,512 | 11/1993 | Chomette et al. | 446/409 X |

FOREIGN PATENT DOCUMENTS

| | | | |
|---|---|---|---|
| 2125754 | 9/1972 | France | 446/437 |
| 1411752 | 10/1975 | United Kingdom | 446/409 |
| 2213069 | 8/1989 | United Kingdom | 273/58 E |
| 2214832 | 9/1989 | United Kingdom | 446/409 |
| 2249036 | 4/1992 | United Kingdom | 446/409 |

*Primary Examiner*—Mickey Yu
*Assistant Examiner*—D. Neal Muir
*Attorney, Agent, or Firm*—Robert F. Zielinski

[57] ABSTRACT

A self-propelled musical toy rolling ball which plays musical tunes and sound effects. The ball may also include decorative images on its surface which may generally correspond to the musical tune or sound effects played by the ball. The electronics of the ball, once energized, operate to propel the ball and simultaneously activate an integrated circuit sound effects chip which plays first sound sequence, typically a musical tune. When the ball bumps into a wall or other object, the propulsion mechanism, typically a drive motor which may be transmissivly connected to a central axis shaft, is disengaged and the circuit then plays a second sound sequence, typically a randomly selected pre-programmed sound effect from one of a plurality of different sounds. Thereafter, the propelling mechanism is again activated and the ball resumes playing the musical tune.

8 Claims, 4 Drawing Sheets

SELF-PROPELLED MUSICAL TOY BALL

FIELD OF THE INVENTION

This invention relates generally to spherical musical toys and more specifically, to a self-propelled musical toy ball.

BACKGROUND OF THE INVENTION

Balls and musical toys comprise what may be some of the oldest types of toys known in the art. Children of all ages enjoy balls of various shapes and sizes because of the inherent simplicity that they possess. Musical toys, on the other hand, are particularly appealing in that they hold a child's interest and because they may also be more easily enjoyed in solitary play.

Early musical toys utilized expensive and complex mechanical apparatuses for producing musical sounds. These early apparatuses often tended to be relatively cumbersome and equally often, easily damaged. As a result, the character of musical toys for many years has been limited and sometimes expensive. However, the recently developed integrated circuit music-producing systems have provided a plentiful supply of relatively inexpensive and durable electronic circuits for producing music and other sound amusement. As a result, a greater variety of music and sound producing toys have been provided in various shapes and configurations. Some of the most interesting types of musical toys are those which combine the simple spherical shaped ball with an internal battery-powered, sound-producing mechanism.

Musical toys in which a spherical ball is provided with sound-producing mechanisms include, for example, U.S. Pat. Nos. 1,709,841 and 1,789,333 to DaCosta which disclose a tone producing toy and a toy, respectively, having a hollow spherical ball within which a mechanically actuatable rate responsive sound producing mechanism is disposed.

U.S. Pat. No. 2,780,029 to Anthony pertains to a toy ball with a music box disposed therein. That reference discloses a hollow ball separable into a pair of hemispheres and includes a diametrically extending interior bracket in each of the hemispheres. A music box is supported on the underside of one bracket and a threaded fastener cooperates with the brackets to secure the hemispheres together to form a music box enclosing sphere.

U.S. Pat. No. 3,935,669 to Potruzski et al. discloses an electrical signal mechanism actuated in response to rotation about any of three axes in which an object such as a baton, a ball or the like, produces an output signal such as sound or light solely when the object is rotated. The object includes an internal power source together with plurality of centrifugal force responsive switches coupled thereto. The internal electric mechanism is actuated in response to the centrifugal switches detecting ball motion.

U.S. Pat. No. 4,662,260 to Rumsey discloses a sound-producing ball which produces three different tones when rotated. The three orthogonally mounted gravity switches produce signals corresponding to their orientation and a multiplexor coupled to the switches selects one output condition for each combination of the switched output signals. The output of the multiplexor is coupled to an oscillator and speaker producing various tones in response to orientation.

U.S. Pat. No. 4,737,134 to Rumsey also sets forth a sound-producing ball having a multiple tone sound-producing circuit. In this reference, a light transducer is supported at the surface of the ball and produces signals corresponding to the amount of a illuminating light sensed by the transducer. An oscillator is coupled to the light transducer to provide tones used to drive a speaker. A motion switch is coupled to the oscillator to shut off production of the sound when the device has been at rest for a predetermined time interval.

U.S. Pat. No. 4,801,141 to Rumsey pertains to a light and sound producing ball which produces one or more areas of light in a ball in response to the orientation of the ball with respect to gravity. A tone generator and speaker are included with the ball to provide unique audio tones for each orientation of the device. Switches and timers are provided to control the volume output and rate of generation of tones and light signals by movement of the ball by a predetermined series of positions, thereby obviating the need for external switches.

U.S. Pat. No. 4,931,029 to Hwang relates to a musical toy tumbler. That reference discloses a generally egg-shaped toy supporting an ornamental head portion which is weighted so as to maintain a generally vertical orientation with the head extending upward. A sound-generating integrated circuit and a plate spring type microswitch are supported within the base of the toy tumbler. The microswitch turns off the sound generating integrated circuit in the absence of a rocking motion for a predetermined period of time.

U.S. Pat. No. 5,049,107 to DeNittis discloses a sound box device in which a spherical container is provided with a surface depicting a plurality of graphic areas or fields. A corresponding plurality of electrical contacts are positioned beneath the graphic fields and are coupled to a microprocessor within the container. A loudspeaker and circuitry within the spherical container responses to the switch contact operation by producing a correspondingly related sound sequence.

Self-propelled balls also represent improvements in children's toys as they are both amusing and, to a certain degree, mystifying to those unfamiliar with their construction. These toys typically have either a friction motor or an electric motor and batteries which are eccentrically mounted about a central shaft, with the propelling means geared towards the shaft so as to move the ball as the propelling means revolves relative to the shaft. For example, U.S. Pat. No. 676,297 to Balding et al. relates to a hollow, self-propelled toy ball powered by a wind-up mechanism mounted on a centrally disposed shaft with the ball.

U.S. Pat. No. 1,033,077 to Ayers discloses a motor propelled ball in which the propelling mechanism is concealed within the interior surface of a pair of hemispheres forming the ball.

U.S. Pat. No. 3,500,579 to Bryer relates to a randomly self-propelled spherical toy powered by a self-contained internal driving unit including a friction wheel rotated by an electric motor mounted on a supporting platform carrying a battery for energizing the motor. The platform and the driving wheel engage the inner wall of the sphere at haphazard and constantly varying locations by being completely independent of connection therewith, resulting in an irregular path of travel which automatically veers away from an object with which it collides.

For example, U.S. Pat. No. 4,601,675 to Robinson discloses a mechanized ball which includes a hollow sphere having a removable hatch through which a powered ball driving unit can be placed within the sphere and removed therefrom. The ball driving unit can be electrically or mechanically powered and may be in the form of a singled powered driving wheel or a self-contained four-wheel toy vehicle.

From the foregoing, it may be appreciated that propelled motorized balls represent improvements over non-motorized and/or non-propelled children's toy balls. However, self-propelled balls are limited in their overall appeal and while the foregoing describe certain musical toys and self-propelled balls which have provided some increase in amusement and play value for toys generally, there remains a continuing need in the art for even more interesting and amusing musical toys. The present invention fulfills this need.

SUMMARY OF THE INVENTION

The present invention relates generally to a self-propelled musical toy and more particularly to an electronic motorized rolling ball which plays musical tunes and sound effects. Optionally, the ball may also include decorative images on its surface which may generally correspond to the musical tune or sound effects played by the ball. In one preferred embodiment, the electronics of the ball, once energized, operate to propel the ball and simultaneously activate an integrated circuit sound effects chip which plays a musical tune. When the ball bumps into a wall or other object, the propulsion mechanism, typically a drive motor which may be eccentrically mounted relative to a central axis shaft, is disengaged and the circuit then plays a randomly selected pre-programmed sound effect from one of a plurality of different sounds. Thereafter, the propelling mechanism is again activated and the ball resumes playing the musical tune.

For example, in one preferred embodiment, the ball will roll and simultaneously play the familiar "Old McDonald" tune. The ball will appear to roll spontaneously and present a musical effect when moving. If the rolling ball is stopped by bumping into a wall or some other object, the self propelling means is temporarily disabled and the ball will produce sound effects of one of six different animal sounds such as, for example, a cow, a duck, lamb, dog or cat. After the sound effect is played, the ball once again resumes playing a musical tune and moves until striking another object whereupon another sounding sequence is played, thereafter the "start-play music, stop-play sound effects, start-play music" sequence repeated for a predetermined number of times, or for a predetermined time period, or until the unit is turned off. In other embodiments, other children's songs and related sound effects may be used.

Accordingly, it is a general object of the present invention to provide an improved musical toy. It is a more particular object of the present invention to provide an improved musical toy which is self-propelled and which provides increased visual amusement and activity interest.

Another object of the present invention is to provide a ball or spherical toy having an internally disposed motor and batteries mounted about a central shaft so as the ball moves, the propelling unit revolves relative to the shaft and simultaneously activates a circuit to provide a musical tune.

Still another object of this invention is to provide a toy of character which is simple in construction and durable in use and comparably easily manufactured in mass production.

Another object of the present invention is to provide a musical toy of the above character that can be relatively inexpensively manufactured and which can be also employed for use in children's games, if desired.

Finally, it is another object of this invention to provide a toy wherein the toy body provides for a complete enclosure and protection of the motion means and other mechanisms to present only a smooth, resilient and semi-rigid exterior surface to prevent damage to a user, in particular, to infant users.

With these and other objects in view, the invention consists in the combination arrangement of the elements as set forth in the following specification and particularly pointed out in the appended claims.

BRIEF DESCRIPTION OF THE DRAWINGS

The features of the present invention, which are believed to be novel, are set forth with particularity in the appended claims. The invention, together with the objects and advantages thereof, may be best understood by reference to the following description taken in conjunction with the accompanying drawings and in the several figures of which like reference numerals identify like elements and in which:

DETAILED DESCRIPTION OF THE PREFERRED EMBODIMENTS

Figure 1:
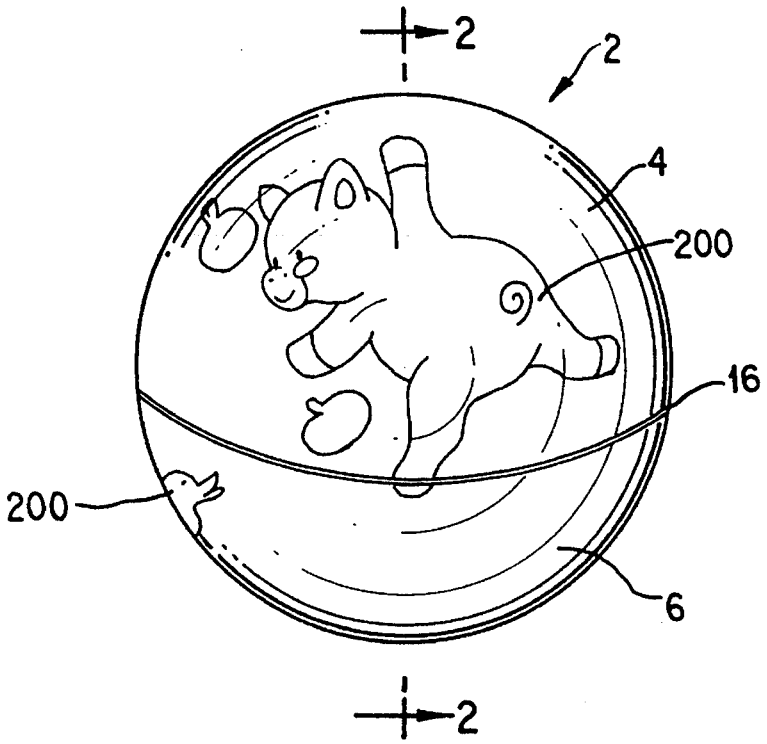
FIG. 1 sets forth a perspective view of a self-propelled musical toy ball constructed in accordance with the present invention.
Figure 2:
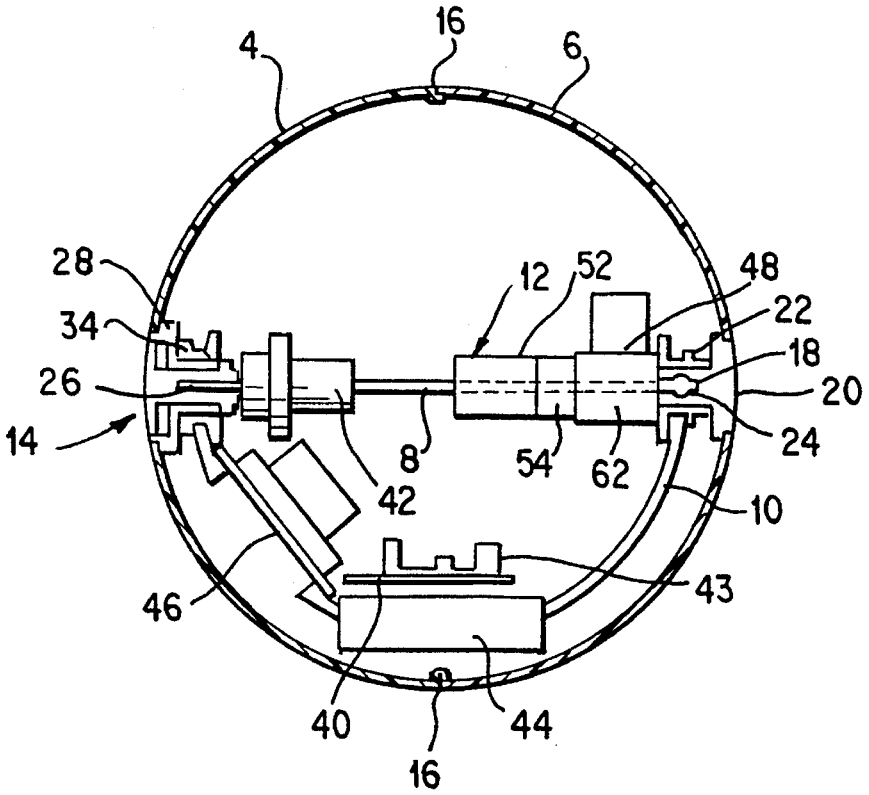
FIG. 2 sets forth a cross sectional view of the musical toy ball of the present invention taken along the section lines 2—2 in FIG. 1.

As illustrated in the drawings, the present toy 2 is a sphere or ball formed from a pair of integrated hemispheres 4 and 6 which may include optional images 200 on its surface. Shaft 8 extends substantially axially between the hemispheres and is rigidly connected to hemisphere 6 and rotatably connected to hemisphere 4. A frame or housing 10 enclosed within the sphere is carried by and is rotatable about shaft 8. Power means 12 is carried within the housing and is essentially disposed centrally on shaft 8. As used herein, power means includes the drive means, typically an electric motor together with any associated gearing as well as a power source for the drive means. In the embodiment shown the power means and associated gearing is carried essentially concentrically in relationship to shaft 8. In alternate embodiments, such as that shown in FIGS. 3 and 4, power means may be carried within the housing in more or less eccentric relation to the shaft 8. In either configuration, it will be appreciated that it is necessary to connect power means 12 to shaft 8 for rotating housing 10 relative to the sphere and include a suitable switch means 14 for controlling operation of said power means.

Hemispheres 4 and 6 are made of rigid material such as plastic or the like. Preferred plastic materials include ABS plastics, polycarbonates and/or other styrene plastics which are durable and generally impact tolerant. The circumferential edge portions of hemispheres 4 and 6 are formed in stepped fashion as indicated at 16 so that the hemispheres may interlock and present a smooth continuous surface across the juncture of the hemispheres which will not impede or otherwise interfere with the rolling movement of the sphere. A stepped engagement of hemispheres 4 and 6 also ensures maintenance of the generally spherical condition of the toy during use and during rotation of one hemisphere relative to the other about a central axis between the hemisphere without destroying the interlocking engagement of the hemispheres. In other embodiments, however, it may also be desirable to place a raised rib or band-type gasket between the mating hemispheres which may serve to enhance the random path the self-propelled ball may follow.

In the embodiment shown, shaft 8 extends axially along a central axis between the two hemispheres. Shaft 8 is constructed of any suitable structural material such as metal, rigid plastic or the like. One end of shaft 8 is rigidly connected to hemisphere 6 so as to be rotatable therewith. In the illustrated embodiment, this is accomplished by securing one end of shaft 8 into anchor block 18 which is in turn secured by means of fastener 20 between an annular sleeve 22 which is formed integral with and which extends inwardly from the hemisphere. If desired, anchor block 18 may be rectangular in cross section and may fit compressively into a rectangular recess in the sleeve thereby positively preventing rotation of anchor block 20 relative to the hemisphere 6 without relying on the locking action of fastener 22 or other similar means of fixedly securing the shaft. It will, however, be appreciated that the connection between the end of the shaft and anchor block 18 may be made in any suitable matter. In the illustrated construction this is accomplished by swaging or crimping the end of the shaft to provide outwardly extending projections 26 and then press fitting the end of the shaft into a suitable recess within anchor block 18.

The opposite end of shaft 8 extends inwardly towards hemisphere 4. This end of the shaft may be threaded or otherwise adapted to receive and is interengaged by an internal on-off switch 42 which may be activated by external switching means 14 on the surface of hemisphere 4. In this manner, power means 12 may be activated by the inward-outward movement of shaft 8 which also may be spring biased in a manner similar to the spring biased operation of a pocket pen.

In the embodiment shown, the drive means for the present invention includes motor 52 which is seated on shaft 8, gear train assembly 54 and 60, for transmissivly connecting the shaft and motor and bump-switch 48. Bump-switch 48 is connected to circuit 41 of circuit board 40 and comprises a motion detection-type switch which is activated when the ball runs into or otherwise abruptly encounters an object. Actuation of bump-switch 48 causes motor 52 to disengage thereby causing cessation of both the rolling movement and the playing of a first sound sequence, typically a musical tune. Actuation of bump-switch also activates playing of a second sound sequence, typically sound effects. In the preferred embodiment, the musical tune and the sound effects are both stored in the Read Only Memory or ROM of integrated circuit sound effects chip 43 and, as discussed below, are activated upon a signal condition sent from bump-switch 48. In other preferred embodiments, it will be seen that the circuit may also be configured so as to play sound effects as the self-propelled musical toy ball moves and play a musical tune while the toy is in the non-propelled mode. Suffice it to say that the variations to the playing order and number of sound sequences in relation to the propelled and non-propelled operational mode of the disclosed toy is fully intended to be within the scope of the invention. Additionally, in other preferred embodiments, sound sequences may be, at least in part, mechanically generated and directly linked to the rotational movement of the toy.

Figure 3:
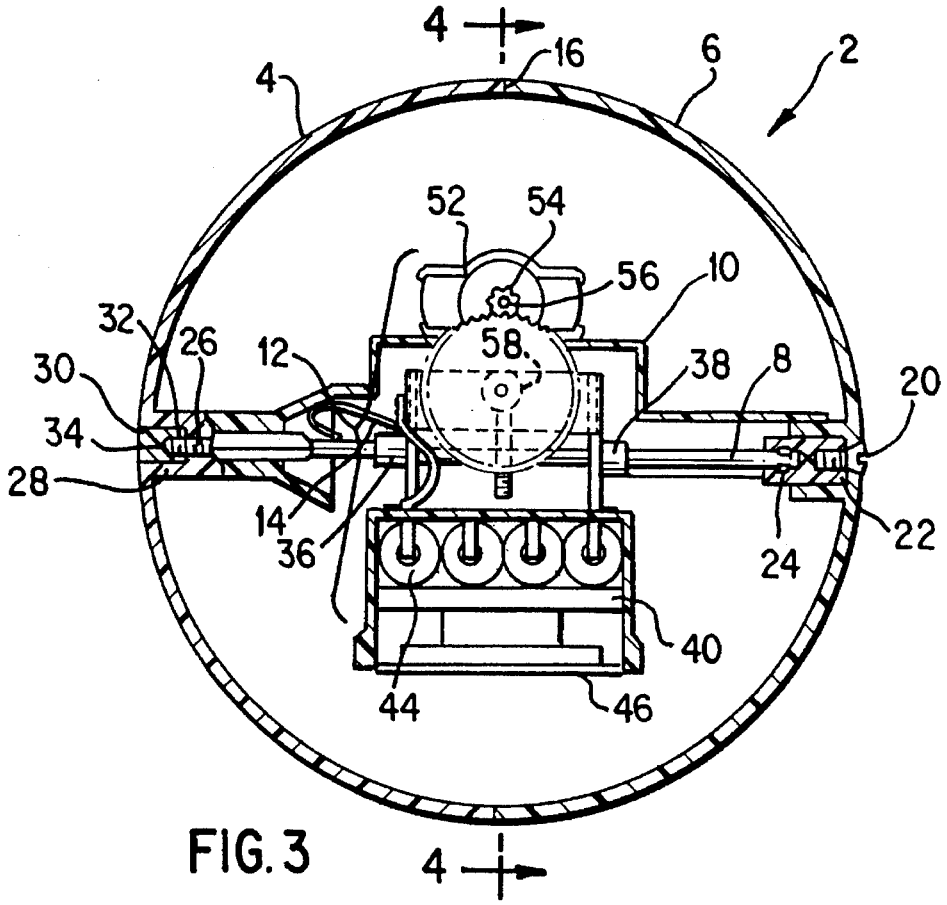
FIG. 3 sets forth a cross-sectional view of an alternate preferred embodiment of the self-propelled musical toy of the preset invention.
Figure 4:
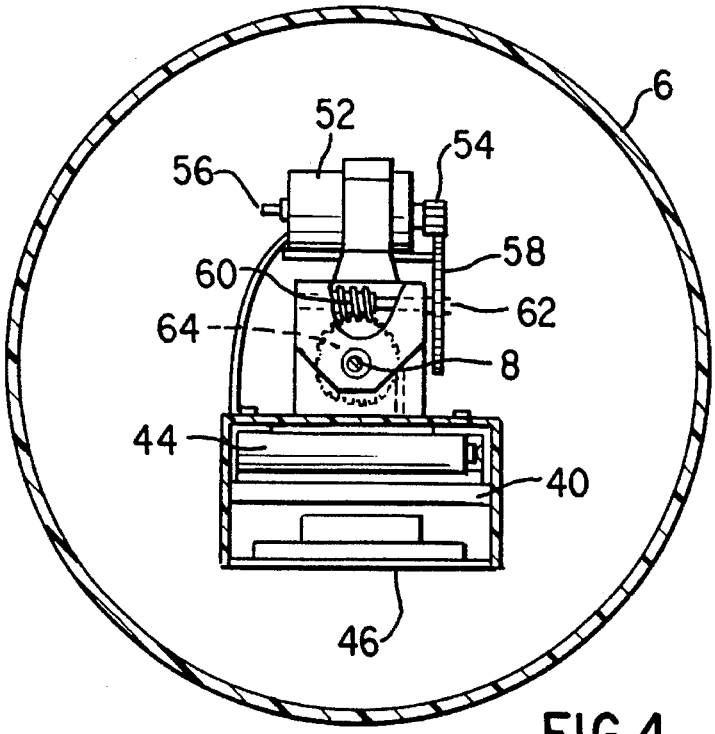
FIG. 4 is a cross-sectional view of the self-propelled musical toy ball taken along the section lines 4—4 in FIG. 3.

In other embodiments, power means for the toy can also include a motor which is seated on an upper surface of a housing bracket which is connected to the shaft through a gear train. The gear train would include a typically a gear wheel attached to the motor shaft, a secondary gear wheel attached to a drive gear which is, in turn, attached to a second shaft journalled in the side walls of a securing or mounting bracket and which is then interengaged with a third gear on shaft 8. In any event, it will be appreciated that there are a number of different battery operated self-propelling means which may be employed in the present invention including those which may be predominantly centrally mounted as shown in the embodiment or alternatively, eccentrically mounted, as shown in FIGS. 3 and 4, as well as other alternative driving means arrangement including those set forth, for example, in U.S. Pat. Nos. 3,500,597 and 4,601,675. Other types of driving mechanisms include those where a definite and fixedly-located connection has been established between the body and the driving unit by means of a shaft either journalled into a hollow body wall or drivingly connected thereto, the driving unit being mounted on the shaft, or adjacent the shaft, or gearing the shaft, so that the driving engagement occurs more or less continuously in the same location or path within the sphere.

As is clear from the foregoing, all that is required to operate the drive means of the toy ball is the rotation of one hemisphere relative to the other, or directly driving the sphere, either of which is responsive to an electrical signal from an initial open circuit position to a closed circuit position and which simultaneously activates a first sound sequence. The motor will then cause rotation of gears which in turn will rotate the shaft by causing the housing to rotate about the gear and the shaft or internally drive the ball directly. When the ball is positioned on a flat surface, activation of the power means and its related elements will cause the ball to begin rotating. When the ball is rotating, a first sound sequence, typically a musical tune, is played. When the ball comes into contact with an obstruction, it will stop, present a second sound sequence, typically sound effects, and upon completion of the second sound sequence, then resume movement about the obstruction, playing the first sound sequence and so on. The movement of the ball may also be controlled in a simple manner by the operator by the means of a suitable stick or baton.

The lower end of the housing 10 is provided with a platform which is of a size large enough to carry electronics circuit board 40. Circuit board 40, as discussed in greater detail below provides a means for interconnecting the components of an electronic circuit which, generally includes on-off switch 42, integrated circuit sound effects chip 43, power source 44, speaker 46 and bump-switch 48, as well as other discreet components (i.e. resistors, transistors, capacitors, etc.). Circuit board 40 is constructed in accordance with conventional fabrication techniques. Integrated circuit sound effects chip 43 in its simplest form, provides a tone output or song capability and a sound effect capability. It will be apparent to those skilled in the art that virtually any one of the presently available musical tone producing circuits may be utilized for printed circuit board 40 without departing from the spirit and scope of the present invention. Circuit board 40, including chip 43 is typically provided in die form available from a variety of different manufacturers. A particularly suitable chip is the WINBOND W52706 six second sound chip which may be preprogrammed with both music and sound effects.

Figure 5:
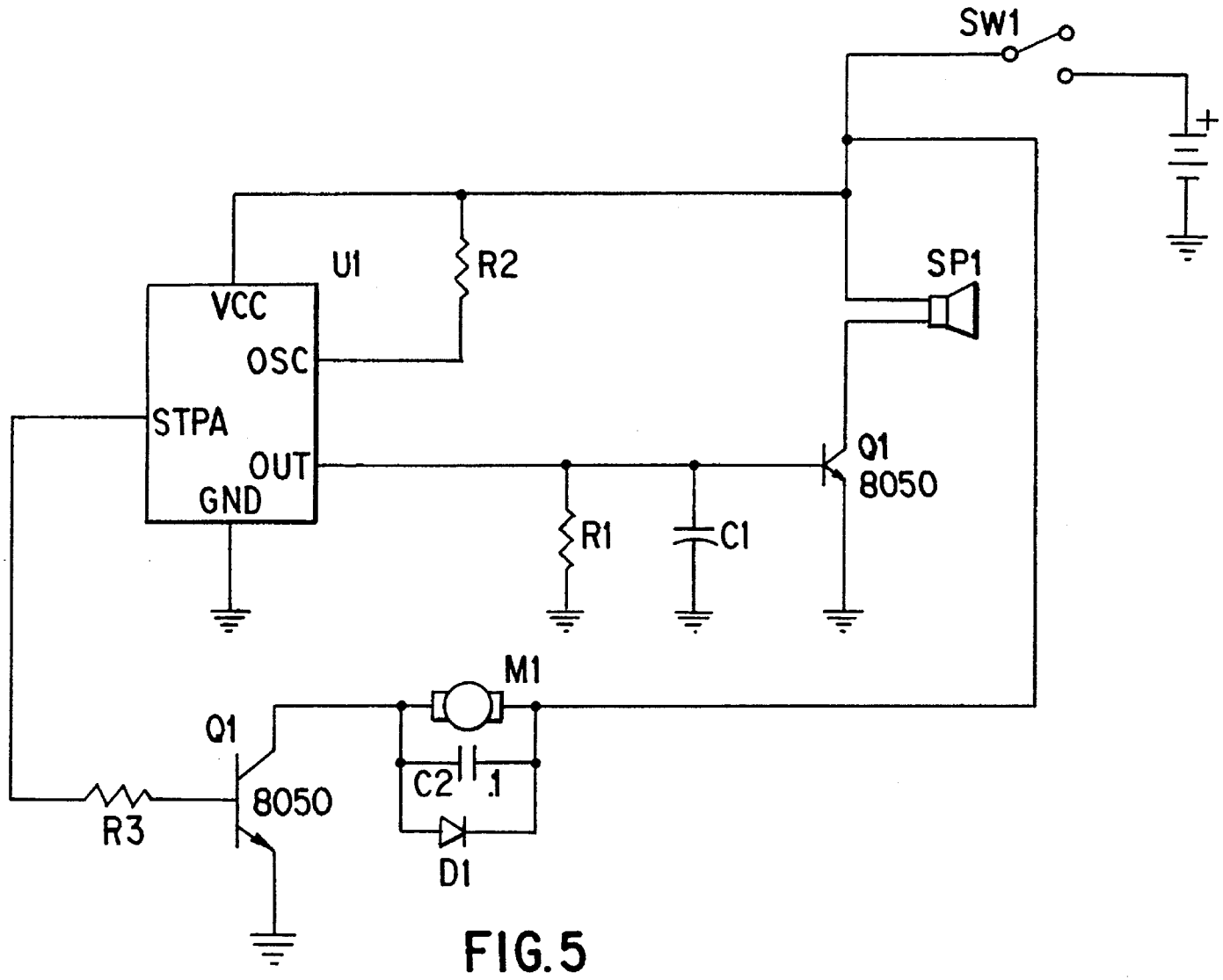
FIG. 5 sets forth a schematic of an electronic circuit of the type utilized in the present invention.

As shown in the drawings, with particular reference to the schematic representation of a typical circuit shown in FIG. 5, the circuit is constructed in accordance with conventional fabrication techniques including a printed circuit board 40 having appropriate electrical conduits for providing electrical connection to the various elements of the circuit. Supported on housing 10, printed circuit board 40 should be understood to be supported within and connected to other elements of the circuit (e.g. motor 52, on-off switch 42, IC chip 43, power source 44, speaker 46 and bump-switch 48) in accordance with conventional fabrication techniques. For example, speaker 46 may also be supported on the lower portion of housing 10 and is coupled to the circuit by a plurality of electrical wires or conduits.

The interruption or sufficient disturbance of the rotational movement of the self-propelled musical toy ball of the present invention causes the motion detection means within bump-switch 48 to cause at least one of a pair of resilient wire electrical contacts to engage the other. It will, of course, be understood that the motion detection means within bump switch 48 is not limited to a resilient wire type switch but also includes piezo electric type capacitor and/or diodes which can be substituted therefor. The open circuit condition of bump-switch 48 provided by the rotating action of ball 2 provides a signal input to IC chip 43 of circuit of circuit board 40 to play a first sound sequence. When an object is encountered, bump-switch 48 signal moves to a closed condition causing motor 52 to temporarily disengage which sends a signal to IC chip 43 to play a second sound sequence. In one mode of operation, circuit 40 responds to the absence of an input signal from bump-switch 48 to play a predetermined musical note sequence (e.g. a song) which is applied to speaker 46 to provide sound output for toy 2. In its preferred form, the output of speaker 46 will be sufficiently adjusted to permit audibility of the sound sequences through the enclosed sphere comprising the toy, although it will be appreciated that a speaker output grill (not shown) may be fashioned within the surface of the sphere.

Figure 6:
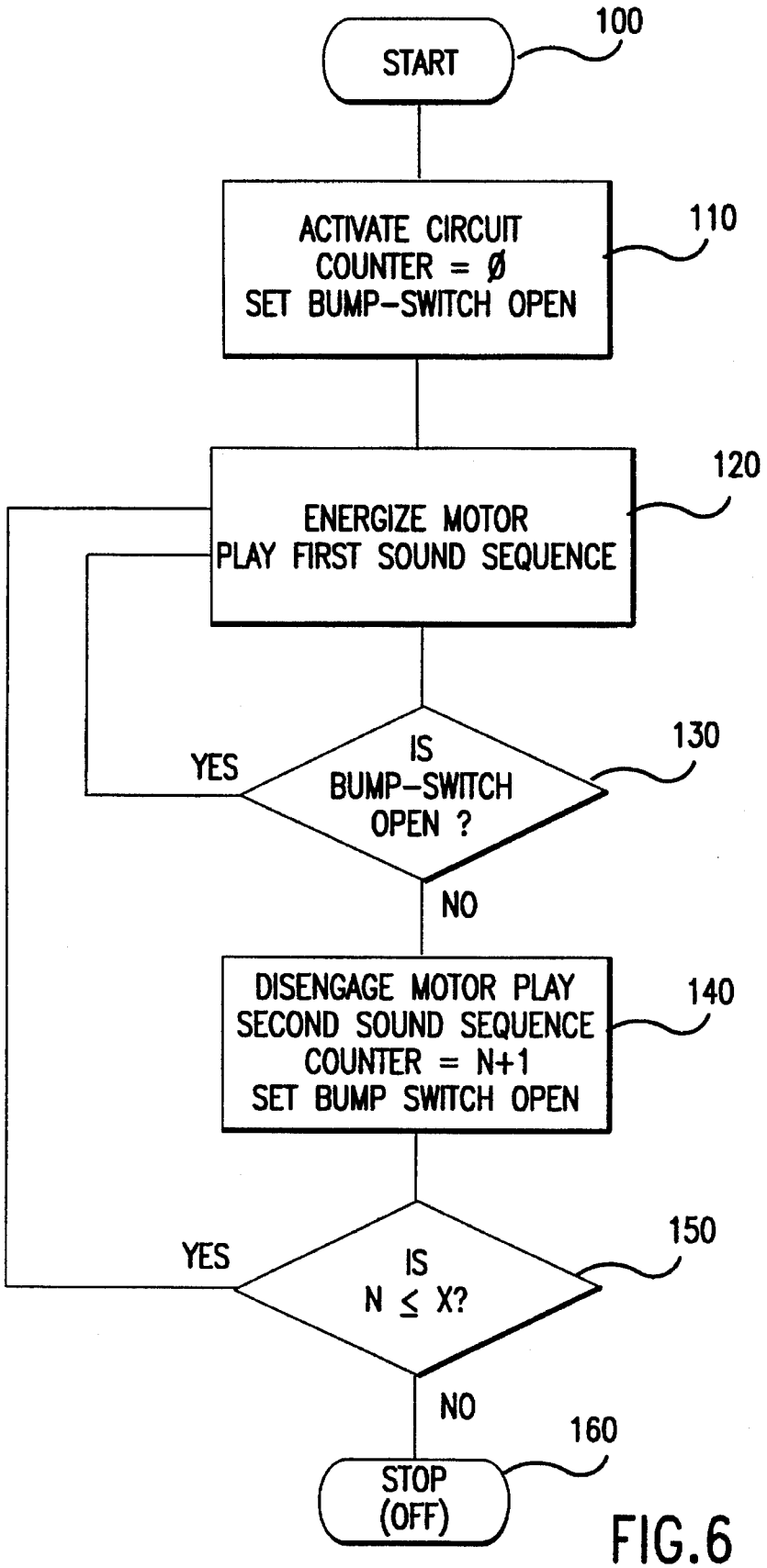
FIG. 6 is a flow chart illustrating the operation of the self-propelled musical toy ball of the present invention.

Printed circuit board 40 is operatively coupled to on-off switch 42, IC chip 43, power source 44, speaker 46, bump-switch 48 and motor 52 in a manner defining at least two different modes of operation, each with a corresponding sounding sequence. With reference to the flow chart in FIG. 6, the on-off switch is first moved to the "on" (start) position 100. The circuit is then activated, counter is set to zero and bump-switch set to open shown at 110. Electrical motor is energized causing the ball to roll and the circuit plays a first sound sequence, typically a succession of musical notes, defining a first mode of operation shown at 120, which provides both a musical and visual entertainment in response to the open signal condition of the bump-switch shown at 130. When an object is encountered, causing bump-switch to send a closed signal condition, the electrical motor is temporarily disabled and the circuit then plays a second sound sequence and one is added to the counter, shown at 140, defining a second mode of operation. A counter checks whether a threshold value has been reached, shown at 150, and if not, the first mode of operation, shown at 120, is resumed. Thus, the child user observes a first mode of operation; the self-propelled rolling motion of the toy ball accompanied by an associated series of musical tones until the toy ball encounters an object, whereupon a second mode of operation will be observed; sound effects while the toy ball is stationary or at rest, and then resumption of the first mode of operation to add further amusement and entertainment to the toy. As exemplified by FIG. 6, the number changes in the operational modes of the toy ball can be limited to a preset value (e.g. 36), or alternatively, to a predefined time limit (e.g. 5 mins.) before it will be necessary to reset the circuit via the on-off switch.

FIGS. 3 and 4 show an alternate embodiment of the present invention which likewise includes a pair of interengaged hemispheres 4 and 6 which form a sphere or ball 2. Shaft 8 extends axially between the hemispheres and is rigidly connected to hemisphere 6. Housing 10 enclosed within the sphere is carried by and rotatable about the shaft 8. Power means 12 carried within the housing in eccentric relation to shaft 8. The power means is suitably connected to shaft 8 for rotating housing 10 relative to the sphere, and switch means 14 for controlling the operation of said power means. Shaft 8 extends substantially axially along a central axis between the hemispheres 4 and 6. The shaft is constructed of any suitable structural material such as metal or the like. In the embodiment shown, one end of shaft 8 is rigidly connected to hemisphere 6 so as to be rotatable therewith. This may be accomplished by fixedly securing one end of shaft 8 in one end of a short resilient bushing or anchor block 18 which in turn is secured tightly by means of fastener 20 in an annular sleeve 22 which is formed integrally with and which extends inwardly from the hemisphere. The connection between the end of the shaft 8 and anchor block 18 relative to hemisphere 6 can be made in any suitable manner. In the illustrated construction, this is accomplished by swaging the end of the shaft to provide outwardly extending projections 24 and then press-fitting the end of the shaft into a suitable recess in anchor block 18.

The opposite end of the shaft 8 extends through passageway 26 in an inwardly extending axially positioned boss 28 on hemisphere 4. This end of the shaft is threaded and is interengaged by a cap nut 30 which extends into an enlarged recess 32 in hemisphere 4 and outer portion of boss 28. The length of shaft 8 is such that cap nut 30 may be rotated to bring the edges of the hemispheres in close abutting interengaged relation to each other. The cap nut and the recess in which it fits are circular in cross-section, and of uniform diameter so that the hemispheres can be rotated relative to each other without causing a loosing or tightening of the nut on the end of the shaft. As seen in FIG. 3, the recess 32 is somewhat larger in diameter than the passageway 26 thereby providing an annular shoulder 34 which provides a limiting position for the inner end of the cap nut 30.

Housing 10 is arranged so as to be freely rotatable about the shaft 8. The housing is provided with suitable diametrically opposed openings 36 and 38 located at upper end portions of housing 10 through which the shaft 8 and associated elements of the toy extend. The openings 36 and 38 are of a size such that the housing 10 may freely rotate relative to the shaft 8 and hemispheres 4 and 6.

In the embodiment shown in FIGS. 3 and 4, the driving means for the toy includes a motor 52 which is seated on an upper surface of housing 10 and connects to shaft 8 through a gear train which includes first gear wheel 54 attached to the motor shaft 56, second wheel 58 and a worm gear 60 attached to drive shaft 62 journalled in a side wall of housing 10 and a drive gear 64 on shaft 8. As seen in the drawing, first gear 54 connects with second gear 56 thereby rotating drive shaft 62 and worm gear 60 which is interengaged with drive gear 64 on shaft 8.

As in other preferred embodiments, lower end of housing 10 is provided with a platform which is of a size large enough to carry electronics circuit board 40. Circuit board 40, as discussed in greater detail below provides a means for interconnecting the components of an electronic circuit which, generally includes on-off switch 42, integrated circuit sound effects chip 43, power source 44, speaker 46 and bump-switch 48, as well as other discreet components (i.e. resistors, transistors, capacitors, etc.). Circuit board 40 is constructed in accordance with conventional fabrication techniques. Integrated circuit sound effects chip 43 in its simplest form, provides a tone output or song capability and a sound effect capability.

In FIG. 5, there is shown a schematic representation of one example of a circuit suitable for use in the instant invention. With reference to the various elements shown in the drawing, S1 represents the circuit switch connected to power source PS. U1 is an sound effects chip, such as the WINBOND W52706 6 second integrated circuit provided in die form. Resistors R1–R3 are typically ¼ watt 5% carbon composition. C1 and C2 are ceramic capacitors, ranging from 100K ohms to 1 Mega ohm, and are preferably from 200 to 500K ohms. M1 is a 2 to 9 volt, and more preferably a 4.5 volt electric motor. Q1 are NPN type driver transistors, typically 8050. D1 is a 1N4001 and SP1 is a speaker, typically an 8 ohm mylar cone speaker. Departures from and variations and modifications to the schematic and the circuit generally set forth will be readily apparent to those skilled in the art and are intended to be with in the scope of the invention.

While the invention has been described in connection with what are considered to the most practical and preferred embodiments, it is understood that the invention is not limited to the disclosed embodiments, but on the contrary, is intended to cover various modifications and equivalent arrangements included within the spirit and scope of the appended claims. Without further elaboration, the foregoing will so fully illustrate my invention, that others make by current or future knowledge, readily adapt the same for use under the various conditions of service.

We claim:

1. A toy comprising a self-propelled musical toy ball including:

a pair of hemispheres having peripheral edges defining a plane for engaging said hemispheres and which are interengaged to form a generally hollow sphere having an axis of rotation;

a shaft positioned within said hollow sphere and extending substantially through the axis of rotation of said sphere, said shaft being rigidly connected to at least one of said hemispheres;

a housing rotatably supported on said shaft, said housing supporting an electronic circuit board interconnecting elements of a circuit, said circuit comprising power means energizing said circuit, integrated circuit means providing a plurality of operational modes and sound sequences to said energized circuit, drive means for rotating said shaft in response to said energized circuit, transducer means for playing a sound sequence responsive to said operational modes, means for temporarily disengaging and re-engaging said drive means in response to said operational modes and switch means for selectively activating said circuit.

2. The toy of claim 1 further including a first sound sequence and sound sequence.

3. The toy of claim 2 wherein said first sound sequence is a musical tune.

4. The toy of claim 2 wherein said first sound sequence is a sound effect.

5. The toy of claim 2 wherein said second sound sequence is a musical tune.

6. The toy of claim 2 wherein said second sound sequence is a sound effect.

7. The toy of claim 2 wherein said first sound sequence is a musical tune and said second sound sequence is a sound effect.

8. The toy of claim 2 wherein said first sound sequence is a sound effect and said second sound sequence is a musical tune.

* * * * *